US007770531B2

(12) United States Patent
Hardell et al.

(10) Patent No.: US 7,770,531 B2
(45) Date of Patent: Aug. 10, 2010

(54) BUMPER ASSEMBLIES FOR MODULAR BARGES AND METHODS THEREFOR

(75) Inventors: Thomas Jason Hardell, Point Pleasant, NJ (US); Volkan Yargici, Ocean City, NJ (US)

(73) Assignee: George Harms Construction Co., Inc., Farmingdale, NJ (US)

( * ) Notice: Subject to any disclaimer, the term of this patent is extended or adjusted under 35 U.S.C. 154(b) by 21 days.

(21) Appl. No.: 12/025,405

(22) Filed: Feb. 4, 2008

(65) Prior Publication Data

US 2009/0194009 A1 Aug. 6, 2009

(51) Int. Cl.
*B63B 59/02* (2006.01)

(52) U.S. Cl. ..... 114/219

(58) Field of Classification Search ..... 114/219
See application file for complete search history.

(56) References Cited

U.S. PATENT DOCUMENTS

| | | | | |
|---|---|---|---|---|
| 4,032,126 | A | 6/1977 | Laughlin et al. | |
| 4,084,801 | A | 4/1978 | Landers et al. | |
| 4,293,241 | A | 10/1981 | Helveston et al. | |
| 4,338,046 | A | 7/1982 | Thomerson | |
| 4,378,749 | A | 4/1983 | Leblanc et al. | |
| 4,604,962 | A | 8/1986 | Guibault | |
| 4,607,586 | A | 8/1986 | Taquino | |
| 4,641,999 | A | 2/1987 | Korbuly | |
| 4,662,791 | A | 5/1987 | Spicer | |
| 4,854,258 | A * | 8/1989 | Hausmann et al. | 114/219 |
| 4,938,163 | A | 7/1990 | Capron | |
| 5,353,727 | A | 10/1994 | Goldman | |
| 5,361,715 | A | 11/1994 | Kiedaisch et al. | |
| 5,617,806 | A | 4/1997 | Goldman | |
| 5,697,316 | A * | 12/1997 | Kinkead | 114/219 |
| 5,716,166 | A * | 2/1998 | Phillips et al. | 405/211 |
| 6,928,944 | B2 * | 8/2005 | Stoll | 114/219 |
| 6,951,181 | B1 * | 10/2005 | Lemke | 114/219 |

* cited by examiner

*Primary Examiner*—Stephen Avila
(74) *Attorney, Agent, or Firm*—Maldjian & Fallon LLC; Jon Fallon, Esq.; John P. Maldjian, Esq.

(57) ABSTRACT

A system for protecting a modular barge, which includes a plurality of modular barge sections assembled together using male and female connections, is provided. Each modular barge section has a top surface, a bottom surface, a side wall extending between the top and bottom surfaces, and at least one male connector projecting from the side wall. Some of the male connectors are exposed at an outer peripheral of the barge. A bumper is coupled with the at least one exposed male connector. The bumper extends between the top and bottom surfaces of the modular barge section to which it is attached.

16 Claims, 16 Drawing Sheets

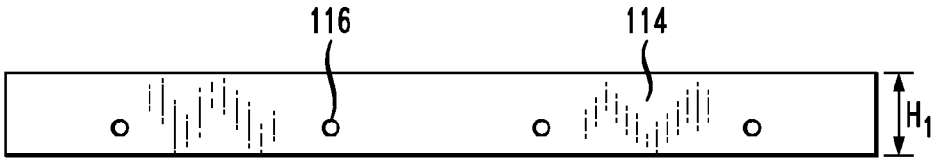
FIG. 12A
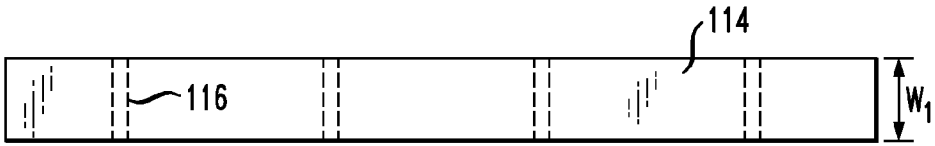
FIG. 12B
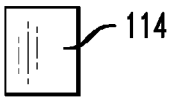
FIG. 12C
FIG. 13C
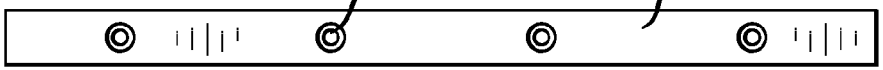
FIG. 13A
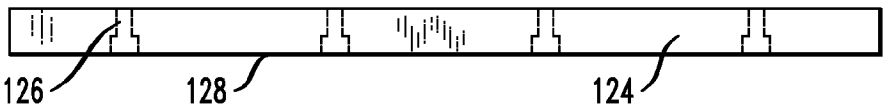
FIG. 13B

BUMPER ASSEMBLIES FOR MODULAR BARGES AND METHODS THEREFOR

BACKGROUND

1. Field of the Invention

Embodiments of the present invention generally relate to barges and docks. More specifically, embodiments of the present invention relate to bumper assemblies for modular barges.

2. Description of the Related Art

It is known to use bumper assemblies to protect ships, boats, barges, docks, and rigs such as oil rigs. These bumper assemblies are needed to both protect the structure carrying the bumper assemblies, as well as any object (e.g., a boat) that may collide with the bumper-bearing structure.

Effort has been directed to providing bumper assemblies for marine structures. For example, U.S. Pat. No. 4,293,241 to Helveston et al. discloses a bumper assembly mounted to a stationary offshore structure. The bumper assembly includes shock absorbing members mounted to the stationary offshore structure and a vertical frame member extending between the shock absorbing members. At each end of the vertical support member, at the point of attachment to the shock absorbing member, a supporting chain or cable is attached to support the vertical member.

U.S. Pat. No. 4,604,962 to Guibault discloses a modular floating dock that includes an interlocking assembly of floating dock units. Each of the floating dock units has four corner eye lugs used to couple adjacent floating dock units together. Nuts and bolts are passed through overlapping eye lugs for connecting adjacent dock units together. After all the floating dock units are assembled together, bumpers are secured in the eye lugs that remain exposed at an outer periphery of the dock.

U.S. Pat. No. 6,951,181 to Lemke discloses a protective fender for a pontoon boat having an upper support member and a lower support member. The fender includes an elongated body formed from a protective material, a first fastening structure connected to the elongated body and being connectable with the lower support member of the boat, and a second fastening structure connected to the elongated body and being connectable with the upper support member of the boat. The protective fender may be readily moved along the length of the pontoon boat to protect a selected section of the boat.

Barges are frequently used to support activities such as river dredging operations, laying underwater pipelines and conducting bridge repair projects. In many instances, a barge is assembled from many different barge sections connected together. Such barges are generally referred to as modular barges.

FIG. 1 shows a conventional modular barge system 50 including modular barge sections 52A-52F. As shown in FIG. 2, the modular barge sections 52A-52F may be coupled or connected together to form a single modular barge 50. The assembled modular barge 50 may be floated in water to support one or more of the activities described above.

Modular barge sections may be connected together using a wide variety of interconnection methods. For example, FIG. 3 shows two modular barge sections 52A and 52B that may be connected together using male connectors coupled with female openings. One version of this type of modular barge is sold under the trademark FLEXIFLOAT, and available from Robishaw Engineering, Inc. of Houston, Tex. The first modular barge section 52A includes a top surface 54, a bottom surface 56, a first side wall 58 and a second side wall 60. The first side wall 58 has a first array of female openings 62A-62D and the second side wall 60 has a second array of female openings 64A-64D. Each of the side walls 58, 60 may have more or fewer female openings than are shown in FIG. 3. The second modular barge section 52B includes a top surface 66, a bottom surface 68, a first side wall 70 and a second side wall 72. The first side wall 70 has an array of male connectors 74A-74D and the second side wall 72 has an array of female openings 76A-76D.

FIG. 4 shows the first side wall 70 of the second modular barge section 52B, and the four male connectors 74A-74D extending from the first side wall 70. The male connectors 74A-74D are adapted to be captured in opposing female openings of an opposing modular barge unit for coupling adjacent modular barge sections together. The male connectors are defined by a first set of male connectors 74A, 74C that are vertically aligned with one another, and a second set of male connectors 74B, 74D that are vertically aligned with one another.

FIG. 5 shows how the male connector of a barge section is received within the female opening of an opposing barge section. In FIG. 5, the second barge section 52B has a male connector 74A extending from the first side wall 70. The male connector 74A includes a base 78 connected with the first side wall 70, a tip 80 spaced from the base, and a reduced diameter neck 82 located between the base 78 and the tip 80. The first barge section 52A has a female opening 62B formed in the first side wall 58, which is adapted to receive the male connector 74A. The first barge section 52A has a locking bar 84 that is moved upwardly to prepare the female opening to receive the male connector. As the opposing side walls of the barge sections 52A, 52B are moved toward one another, the male connector 74A is inserted into the female opening 62B until the reduced diameter neck 82 of the male connector is generally aligned with the locking bar 84. The locking bar 84 may then be moved downwardly, such as by using a sledge hammer, so as to lock the two barge sections 52A, 52B together. The other male connectors on the modular barge section 52B are coupled with opposing female openings of an adjacent barge section in a similar manner.

FIG. 6 shows a fragmentary side view of the second modular barge section 52B shown in FIG. 3. The second modular barge section includes a first male connector 74A and a third male connector 74C. The first and third male connectors are vertically aligned with one another (see FIG. 4) and comprise a first set of male connectors. The first male connector 74A includes a base 78A, a tip 80A and a reduced diameter neck 82A. The second male connector 74C also includes a base 78C, a tip 80C and a reduced diameter neck 82C. The two male connectors 74A, 74C are similar in size and shape.

FIGS. 7 and 8A show a bumper used with the FLEXIFLOAT system to protect at least some of the male connectors 74 extending from the second modular barge section 52B. The bumper 88 is coupled with the first and second male connectors 74A, 74B using loop fasteners 90A, 90B that are attached to the bumper 88. As shown in FIG. 7, the loop fasteners are adapted to engage the neck portions of the respective male connectors. The bumper 88 extends in a horizontal direction and only covers the male connectors 74A, 74B adjacent the top surface 66 of the barge section. The male connectors 74C and 74D adjacent the bottom surface 68 of the barge section remain exposed and unprotected by a bumper.

FIG. 8B shows a perspective view of the second modular barge section 52B after the bumper 88 has been positioned over the first and second male connectors 74A, 74B. The bumper 88, which extends in a generally horizontal direction, is designed to protect the upper male connectors, while the two lower male connectors are not covered by a bumper and thus remain exposed and unprotected. Damages due to the lower connectors are of greater concern because they are not visible while the barges are in water, creating hidden hazards.

FIGS. 9A and 9B shows two barges 50A and 50B floating next to each other in a body of water 94. The first barge 50A has upper male connectors 74A covered by a first bumper 88. The lower male connectors 74C of the first barge 50A are not protected by a bumper. The second barge 50B has upper male connectors 74A' covered by a second bumper 88'. The lower male connectors 74C' of the second barge 50B are not protected by a bumper.

When the first and second barges 50A, 50B have the same draft in the water 94, the opposing male connectors and bumpers 88, 88' are at the same elevation relative to one another. Having two unconnected barges with the same draft is rare in nature and highly unlikely in most applications because it occurs only when the barges and the loads on the barges are identical. In all the other cases, either the barges or the loads on the barges are not identical so the barges are not at the same elevation. These general cases are shown in FIGS. 9A and 9B. The opposing barges are not at the same elevation relative to one another because the first barge 50A has more freeboard than the second barge 50B. The freeboard differences may be due to a number of factors, including the size of the barge, as shown on FIG. 9A, or the load carried by each barge, as depicted on FIG. 9B. As a result, if the barges 50A, 50B engage one another, the bumpers 88, 88' will not prevent the male connectors from colliding with opposing barges. This event (i.e., a male connector striking a side wall of an opposing barge) will generally cause damage to the side walls of the barges.

For example, holes may be punched in the side walls of barges. In many instances, the damage may not even be visible because the damaged section may be below the waterline. The described potential damage may create a need for more frequent inspections and may also require the barges to be unassembled and taken out of water for more frequent inspections, which costs time any money. The cost may be even higher when damage is discovered. In cases of other water vessels engaging into these barges, the invisible lower connectors may also damage the vessel. Such damage is unpredictable for someone who is not familiar with the modular barges increasing the risk of hazard to the other vessel.

Thus, there is a need for improved barge systems and improved bumper assemblies for barge systems, docks, rigs, boats and ships.

SUMMARY OF THE INVENTION

Embodiments of the present invention relate to structures that float in water or are secured in stationary positions after being placed in the water. Such structures have bumpers or fenders attached thereto to prevent damage to the structure that may result when an object collides with the structure. The present invention provides bumpers attached to peripheral regions of such structures. In some embodiments, the structures are modular barges connected together using a plurality of barge sections, each section having male connectors and female openings. The modular barge sections may be assembled together in many different configurations, whereby the male connectors of one modular barge section are inserted into the female openings of an adjacent modular barge section. The process is continued until all modular barge sections are connected together to form a single barge.

After the above-described modular barge sections are assembled together, some of the male connectors may remain exposed at outer edges of the barge. Embodiments of the present invention provide bumpers attached to the male connectors to protect the barge and/or structures that may collide with the barge. In certain embodiments, the bumpers cover one or more of the male connectors exposed at the outer edge of the barge. The bumpers may extend between the top and bottom surfaces of the barge. In certain embodiments, the bumpers may extend in vertical directions between the top and bottom surfaces of the barge.

Embodiments of the present invention comprise bumpers having quick-connecting attachment flanges that engage the male connectors. Unlike known bumpers, embodiments of the present invention comprise bumpers that may be easily attached to the male connectors, without requiring special fasteners or special tools. After use, the bumpers may be easily removed from their attachment to the male connectors. Moreover, embodiments of the present invention comprise bumpers that provide additional protection for the barge that cannot be obtained using known systems.

In certain embodiments of the present invention, a system for protecting a modular barge includes a modular barge section having a top surface, a bottom surface, a side wall extending between the top and bottom surfaces, and at least one male connector projecting from the side wall. The system includes a bumper coupled with the at least one male connector, whereby the bumper extends between the top and bottom surfaces of the modular barge section. In certain embodiments, the bumper extends in a direction that is substantially perpendicular to the top and bottom surfaces of the modular barge section. In certain embodiments, the bumper extends in a substantially vertical direction between the top and bottom surfaces of the modular barge section. Each modular barge section may have more than one bumper coupled therewith.

In certain embodiments, each of the barge sections may have a plurality of male connectors. The plurality of male connectors may include sets of male connectors, whereby the male connectors of each set are vertically aligned with one another. The sets of male connectors may include two or more male connectors that are aligned with one another. In certain embodiments, each set of male connectors exposed at an outer peripheral region of a barge is desirably covered by a bumper having a first end coupled with one of the male connectors of the set and a second end coupled with another one of the male connectors of the set. When first and second bumpers are coupled with male connectors, the adjacent first and second bumpers extend in directions that are substantially parallel to one another.

In certain embodiments, one of the modular barge sections may include a second side wall having at least one female opening formed therein that is adapted to receive one or more male connectors of a second modular barge section. The male connectors are received in the female openings for assembling the first and second modular barge sections together.

Each bumper may have a first end coupled with a first male connector located adjacent the top surface of a modular barge section and a second end coupled with a second male connector located at another level below the top connector level of a modular barge section. The first end of the bumper may have a first attachment flange in contact with the first male connector and the second end of the bumper may have a second attachment flange in contact with the second male connector. The bumper may include a metal frame and at least one insert, such as a wood or rubber or another energy absorbing material insert, attached to the metal frame. The frame desirably has a locking pin opening and the system may include a locking pin insertable into the locking pin opening for securely fastening the bumper to the male connectors of a barge section.

In another embodiment of the present invention, a modular barge includes a plurality of modular barge sections, each modular barge section having male connectors and female openings, whereby the female openings are adapted to receive the male connectors for assembling the modular barge sections together. The modular barge also includes a bumper coupled with one or more of the male connectors exposed at an outer periphery of the modular barge, the bumper extending between a top surface and a bottom surface of the modular barge. In certain embodiments, the bumper extends substantially vertically between the top and bottom surfaces of the modular barge. The bumper desirably has a first end coupled with a male connector adjacent the top surface of the modular barge and a second end coupled with a male connector adjacent the bottom surface of the modular barge. The bumper may include a first attachment flange having an opening extending therethrough and a second attachment flange having a U-shaped opening that extends to a distal end of the bumper. The opening in the first attachment flange has a larger diameter section adjacent a lower end thereof and a smaller diameter section adjacent an upper end thereof.

In another embodiment of the present invention, a method of assembling and protecting a modular barge includes providing a plurality of modular barge sections, each modular barge section having a top surface, a bottom surface, a first side wall with female openings formed therein and a second side wall with male connectors extending therefrom. The method desirably includes assembling the modular barge sections together by inserting at least some of the male connectors into at least some of the female openings, whereby one or more of the male connectors are exposed at an outer periphery of the assembled modular barge, and coupling at least one bumper with one or more of the exposed male connectors, whereby at least one bumper extends between the top and bottom surfaces of the modular barge sections.

In certain embodiments, a modular barge has a plurality of male connectors exposed around the periphery thereof, and the method includes assembling a bumper with each of the exposed male connectors. The bumpers may extend vertically between the top and bottom surfaces of the barge sections. The exposed male connectors may include sets of two or more male connectors that are vertically aligned with one another, whereby each bumper is coupled with one of the sets of male connectors. The assembling step may include coupling a first end of a first bumper with a first male connector adjacent the top surface of a first modular barge section and coupling a second end of the first bumper with a second male connector adjacent the bottom surface of the first modular barge section.

In another embodiment of the present invention, a bumper for a barge includes a frame, such as a metal frame, having a first end and a second end, a first attachment flange extending from the first end of the frame, the first attachment flange including an opening extending therethrough, and a second attachment flange extending from the second end of the frame, the second attachment flange having a U-shaped opening extending therethrough, whereby the U-shaped opening extends to a distal end of the bumper. The opening in the first attachment flange may have a wider diameter section, and a smaller diameter section located between the wider diameter section and a proximal end of the bumper. The frame has a U-shaped cross-section, with an insert, such as an insert made of a wood or polymer material, disposed in the U-shaped cross-section. The frame desirably has opposing side walls and aligned openings in the opposing side walls. The insert has openings extending therethrough that are aligned with the aligned openings in the side walls of the frame. Fasteners may be placed through the aligned openings for securing the insert to the frame. The bumper may include a locking pin opening extending through the bumper adjacent the first end of the frame. The bumper may have a locking pin insertable into the locking pin opening.

These and other embodiments of the present invention are described in more detail below.

BRIEF DESCRIPTION OF THE DRAWING

So the manner in which the above recited features of the present invention can be understood in detail, a more particular description of embodiments of the present invention, briefly summarized above, may be had by reference to embodiments, which are illustrated in the appended drawings. It is to be noted, however, the appended drawings illustrate only typical embodiments of embodiments encompassed within the scope of the present invention, and, therefore, are not to be considered limiting, for the present invention may admit to other equally effective embodiments, wherein:

FIGS. 12A-12C show an insert for the bumper shown in FIG. 10;

FIGS. 13A-13C show a lateral insert for the bumper shown in FIG. 10;

Figure 1:
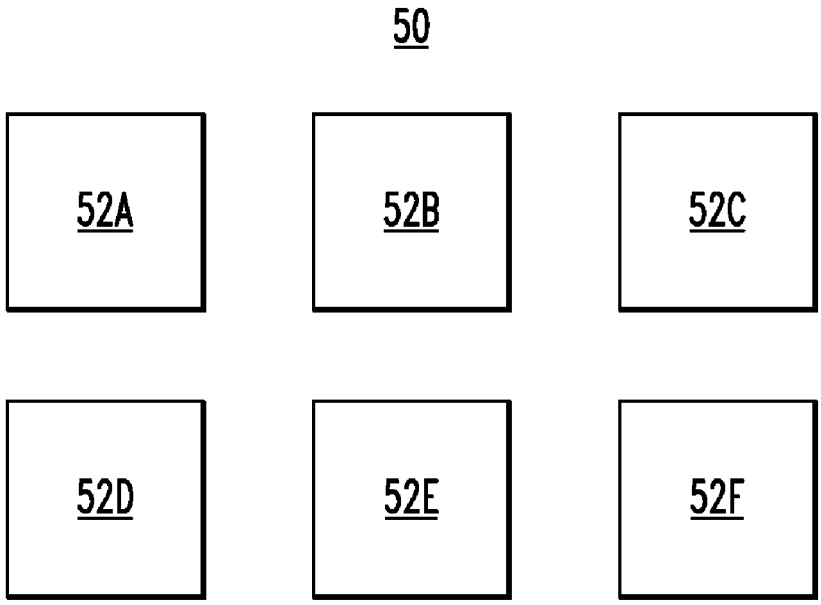
FIG. 1 PRIOR ART
FIG. 1 depicts a conventional modular barge system including a plurality of modular barges.
Figure 2:
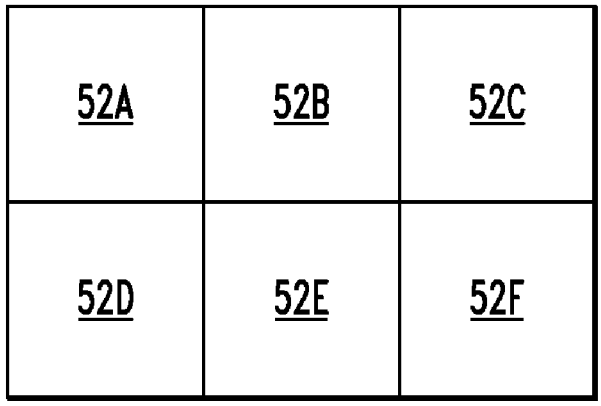
FIG. 2 PRIOR ART
FIG. 2 shows the modular barge sections of FIG. 1 assembled together to form a modular barge.

The headings used herein are for organizational purposes only and are not meant to be used to limit the scope of the description or the claims. As used throughout this application, the word "may" is used in a permissive sense (i.e., meaning having the potential to), rather than the mandatory sense (i.e., meaning must). Similarly, the words "include", "including", and "includes" mean including but not limited to. To facilitate understanding, like reference numerals have been used, where possible, to designate like elements common to the figures.

DETAILED DESCRIPTION

Figure 10:
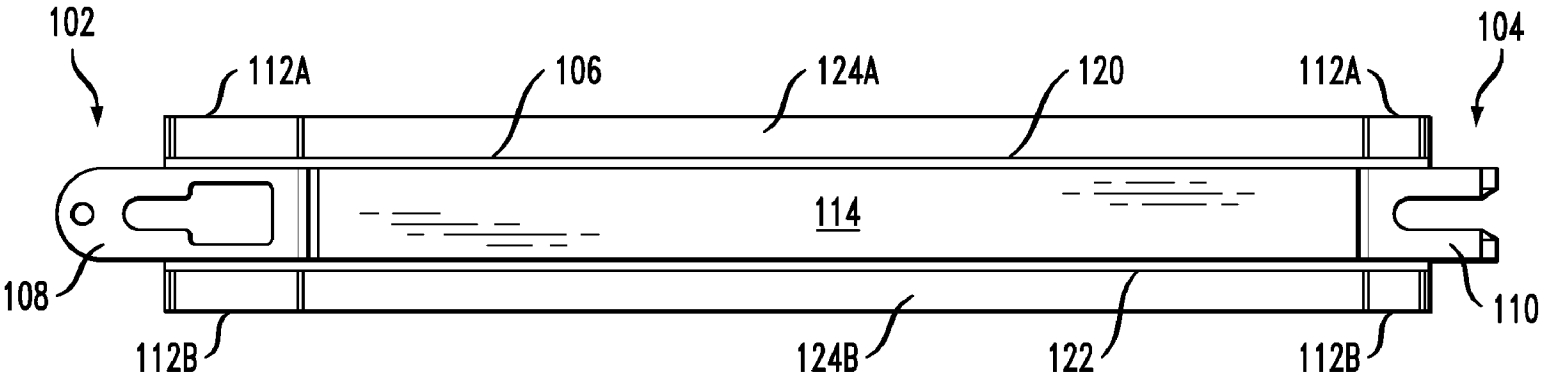
FIG. 10 shows a bumper for a barge, in accordance with certain embodiments of the present invention.
Figure 11:
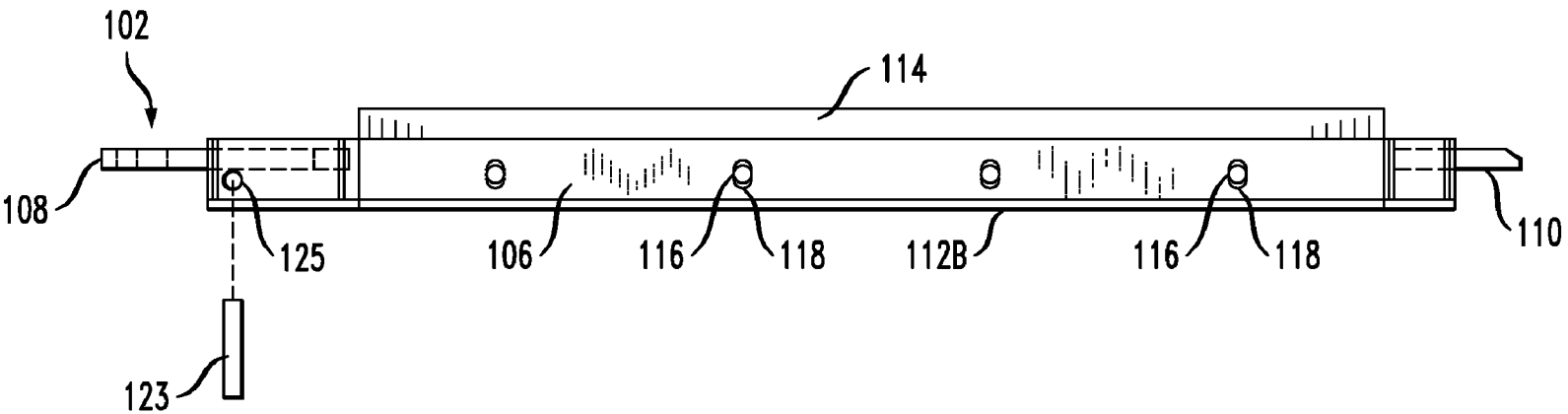
FIG. 11 shows a side view of the bumper shown in FIG. 10.

Referring to FIGS. 10 and 11, in one embodiment of the present invention, a bumper 100 for a barge has a first end 102 and a second end 104. The bumper 100 includes a U-shaped frame 106 that extends between the first and second ends 102, 104. The U-shaped frame may be made of a rugged material such as metal. One type of metal is steel. The U-shaped frame may be made of any material that is able to withstand the forces exerted upon barges or by the sea. The bumper 100 includes a first attachment flange 108 adapted to be coupled with a first male connector (not shown) of a modular barge section and a second attachment flange 110 adapted to be coupled with a second male connector (not shown) of the modular barge section. The first attachment flange 108 is desirably attached to a first end of the frame 106 and the second attachment flange 110 is desirably attached to a second end of the frame 106. The bumper 100 also includes first and second lateral stabilizers 112A, 112B that extend alongside the U-shaped frame 106 between the first and second ends thereof.

The bumper 100 also includes an insert 114, such as a block of marine grade wood, rubber or any energy absorbing material insert, which is disposed in the U-shaped opening of the U-shaped frame 106. The insert has openings 116 extending therethrough that are aligned with openings 118 formed in the side walls 120, 122 of the U-shaped frame 106, depending on the insert structure. After the openings 116 and 118 are aligned, fasteners such as bolts may be passed through the opening for securing the insert 114 to the frame 106. Nuts may be tightened onto the ends of the bolts.

As shown in FIG. 11, the insert 114 has a height greater than the height of the sidewalls 120, 122. In one embodiment, the insert 114 has a length of about 4-6 feet, a height of about 5-7 inches and a width of about 5-7 inches. The length of the bumper is adjusted according to the depth of the barge. In another embodiment, the insert 114 has a length of about 5 feet, 2 inches, a height of about 6 inches, and a width of about 6 inches. The insert may be any energy absorbing material, including laminated or molded rubber or CCA treated, marine grade wood, able to withstand long-term exposure to the elements including sea water. The openings 116 in the insert have a constant diameter. In one embodiment, the openings are drilled through the insert and have a diameter of about one inch.

The bumper also includes two lateral inserts 124A, 124B attached to the frame 106. In one embodiment, the first lateral insert 124A is attached to the first side wall 120 of the frame 106, and the second lateral insert 124B is attached to the second side wall 122 of the frame 106.

Referring to FIG. 11, the bumper 100 includes a locking pin 123 that is insertable into a locking pin opening 125. As will be described in more detail below, after the bumper 100 is coupled with one or more male connectors, the locking pin 123 may be inserted into the locking pin opening 125 to prevent the bumper from decoupling from the male connectors.

FIGS. 12A-12C show the insert 114 that is connected to the frame of FIG. 10. The insert 114 has openings 116 extending therethrough. As noted above, the openings may be about one inch in diameter and are adapted to receive fasteners such as bolts for attaching the insert to the frame 106 (FIG. 10). In certain embodiments, the insert 114 has a length of about 3-5 feet, a width of about 4-8 inches, and a height of about 4-8 inches. The insert may be made of wood, such as marine treated wood, or may be made of any sturdy material that is able to withstand the forces of the sea, and the forces generated when barges collide with one another. The insert may also be made of a polymer material such as rubber or any energy absorbing material.

FIGS. 13A-13C show one of the lateral inserts 124 shown in FIG. 10. The lateral insert 124 is also adapted to be attached to the metal frame 106. As described above, a first lateral insert is adapted to be secured to a first side wall of the frame and a second lateral insert is adapted to be secured to a second side wall of the frame. The lateral inserts are made of a sturdy material such as marine grade wood (e.g., CCA treated) or any energy absorbing material. The lateral insert has a plurality of openings 126 extending therethrough. The diameter of the openings 126 may be larger adjacent one of the side walls 128 of the lateral insert 124. The larger diameter section of the opening 126 enables the head of a fastener to be positioned therein.

In certain embodiments, the lateral insert 124 has a length of about 4-6 feet, a width of about 2-4 inches, and a height of about 3-5 inches. In other embodiments, the lateral insert 124 has a length of about 5 feet, 2 inches, a width of about 3 inches, and a height of about 4 inches. The openings 126 may have a diameter of about one inch. The larger diameter section of the openings 126 may have a diameter of about 2 inches.

Figure 14A:
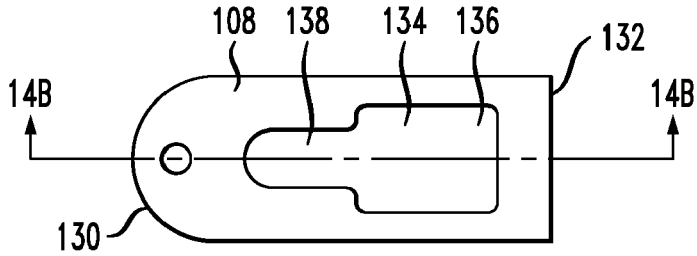
FIG. 14A shows a first attachment flange for the bumper shown in FIG. 10.
Figure 14B:
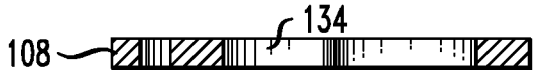
FIG. 14B shows a side view of the first attachment flange shown in FIG. 14A.

Referring to FIGS. 14A and 14B, the attachment flange 108 has a first end 130, a second end 132, and an opening 134 that extends therethrough. The opening 134 has a first larger width section 136 and a second smaller width section 138. In order to couple the first attachment flange 108 with a male connector (not shown), the tip of the male connector is passed through the large diameter section 136. Once the flange 108 is aligned with the reduced diameter neck of the male connector, the first attachment flange 108 and the bumper may be moved toward the bottom surface of the barge section until the smaller diameter section 138 engages the reduced diameter neck of the male connector.

Figure 15A:
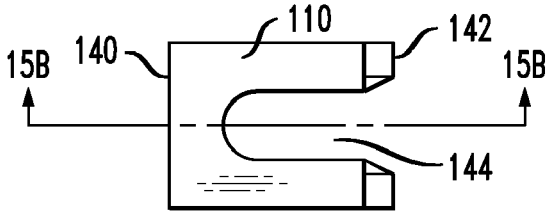
FIG. 15A shows a second attachment flange for the bumper shown in FIG. 10.
Figure 15B:
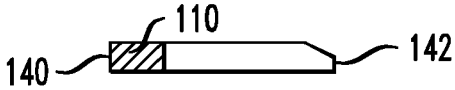
FIG. 15B shows a side view of the second attachment flange shown in FIG. 15A.

Referring to FIGS. 15A and 15B, the second attachment flange 110 has a first end 140 and a second end 142 with a U-shaped opening 144. In order to couple the second attachment flange 110 with a male connector, the U-shaped opening 144 of the second attachment flange is inserted over the reduced diameter neck section of a male connector until the closed end of the U-shaped opening 144 engages the reduced diameter neck. At that point, the bumper cannot move further toward the bottom surface of the barge section.

Figure 16:
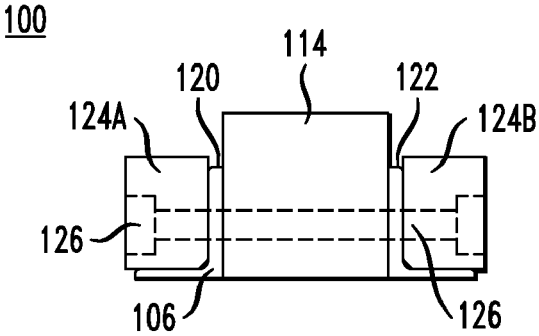
FIG. 16 shows an end view of the bumper shown in FIG. 10.

FIG. 16 shows an end view of the bumper 100 shown in FIGS. 10 and 11 above. The bumper 100 includes the U-shaped frame 106 having side walls 120 and 122. The bumper 100 includes the insert 114, and the lateral inserts 124A, 124B. The openings 126 in the lateral inserts 124A, 124B are aligned with the openings extending through the side walls 120, 122 of the U-shaped frame 106, which in turn are aligned with the openings in the insert 114. As described above, fasteners may be passed through the aligned openings for connecting the insert 114, and the lateral inserts 124A, 124B, with the frame 106. The insert 114 may have a height greater than the height of the side walls 120, 122 of the frame 106, and the height of the lateral inserts 124A, 124B.

Figure 3:
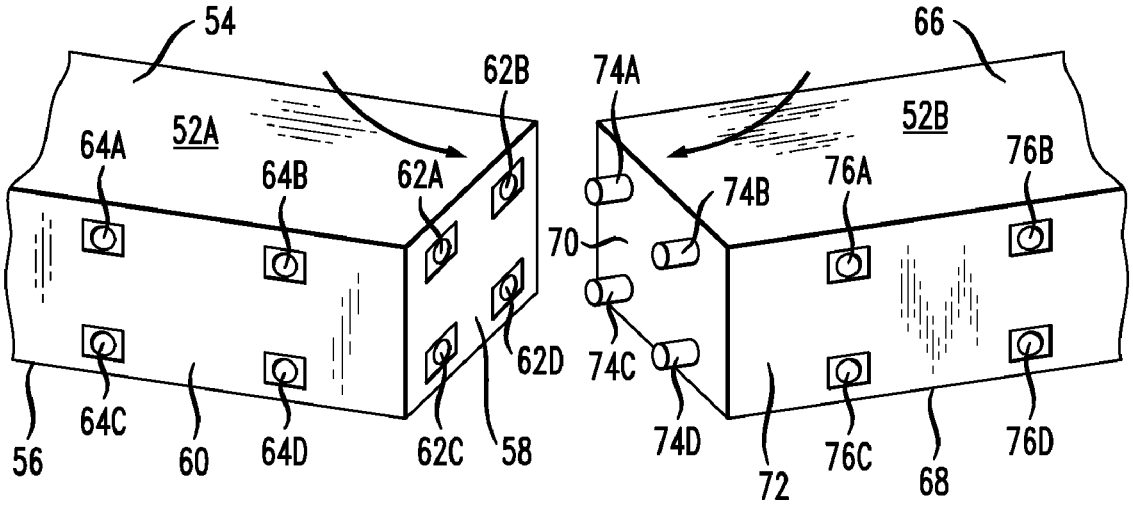
FIG. 3 PRIOR ART
FIG. 3 shows a perspective view of two of the modular barge sections shown in FIG. 1.
Figure 4:
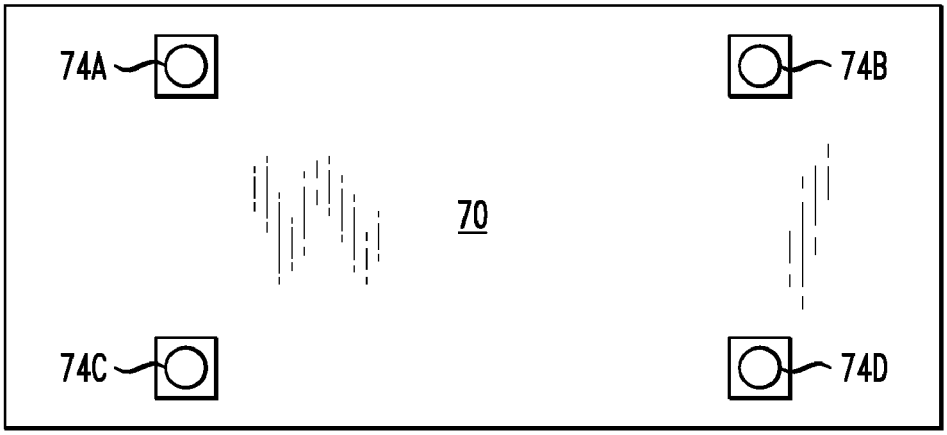
FIG. 4 PRIOR ART
FIG. 4 shows an end view of one of the modular barge sections shown in FIG. 3.
Figure 5:
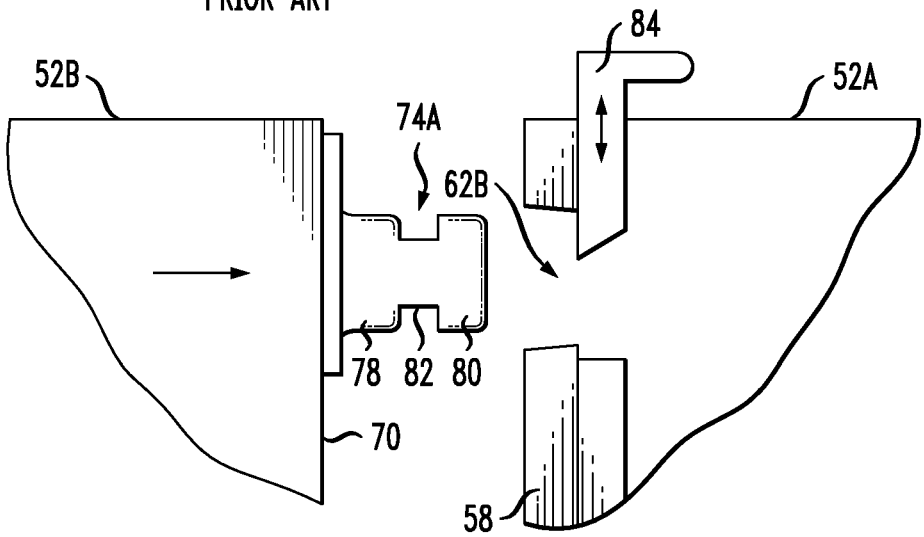
FIG. 5 PRIOR ART
FIG. 5 shows a fragmentary view of the two modular barge sections of FIG. 3 being assembled together.
Figure 6:
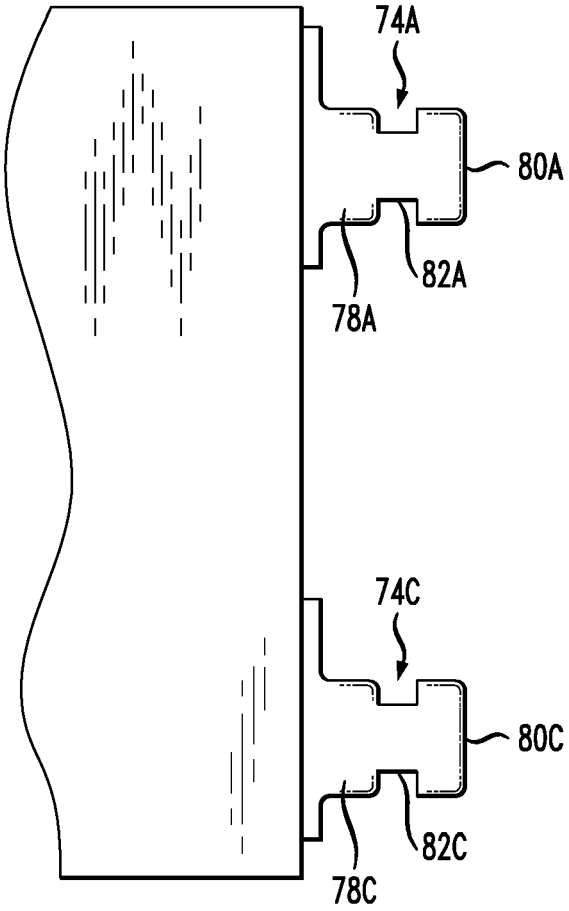
FIG. 6 PRIOR ART
FIG. 6 shows a fragmentary side view of the modular barge section shown in FIG. 4.
Figure 17:
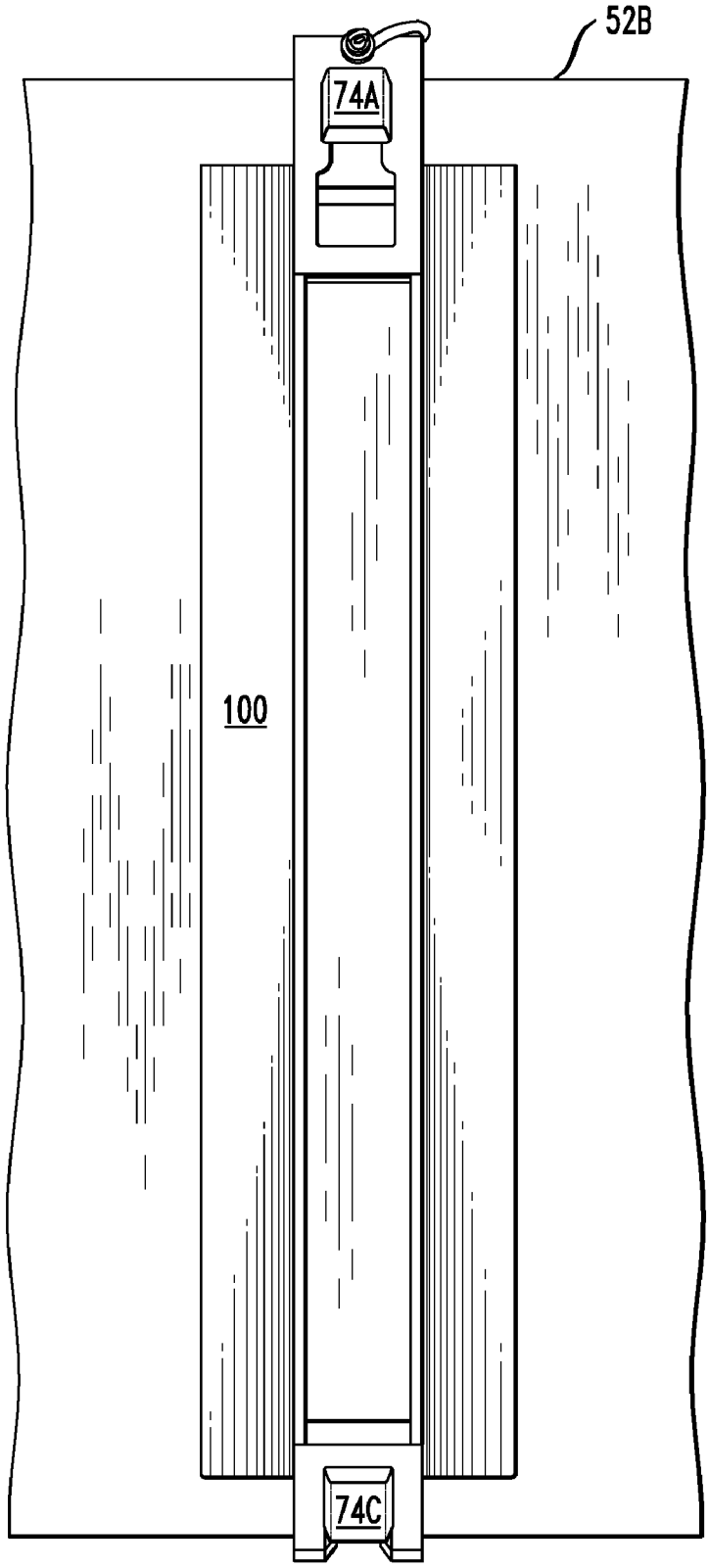
FIG. 17 shows the bumper of FIG. 10 coupled with male connectors of a modular barge section, in accordance with certain embodiments of the present invention.
Figure 18:
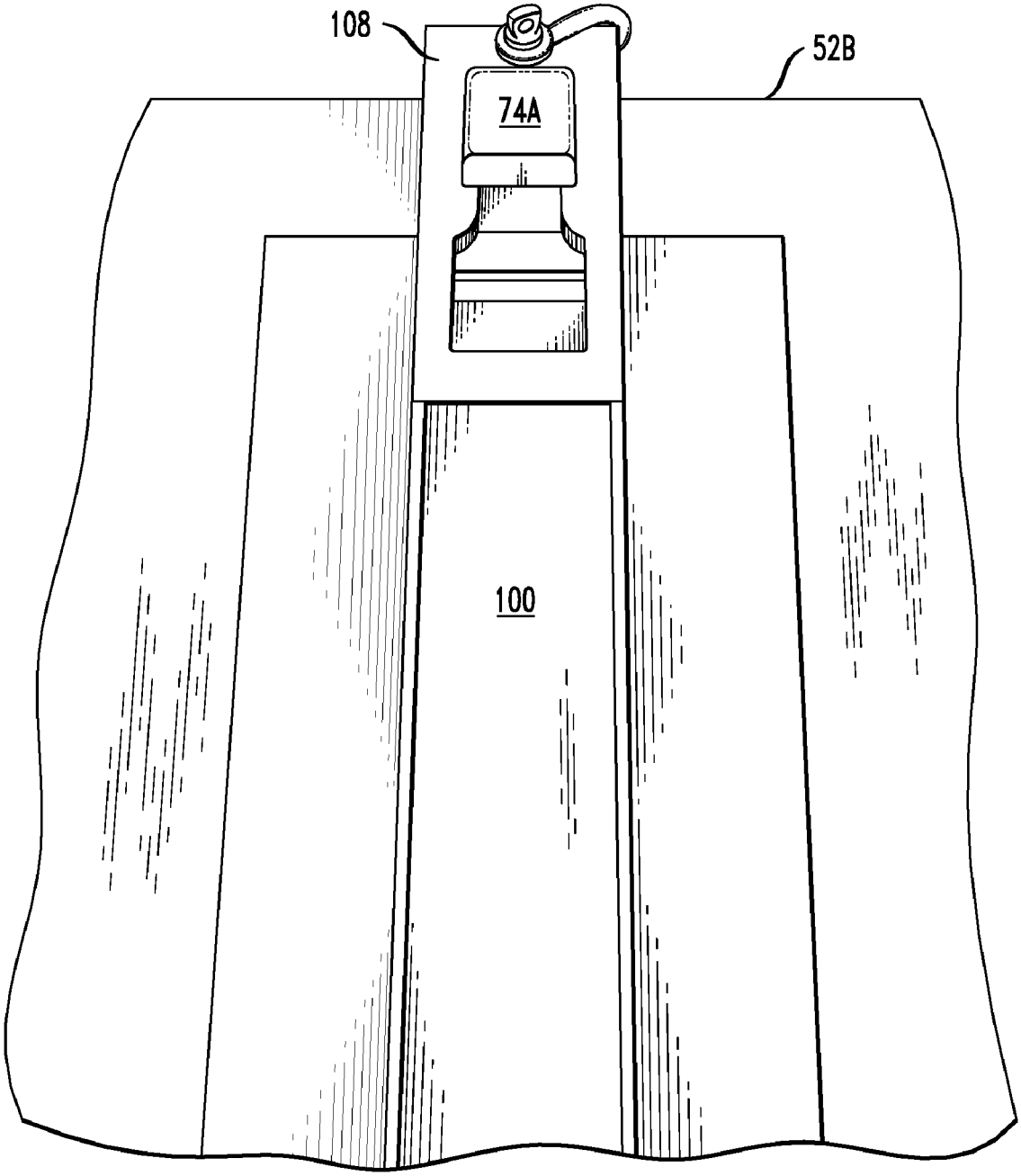
FIG. 18 shows the upper end of the bumper shown in FIG. 17.
Figure 19:
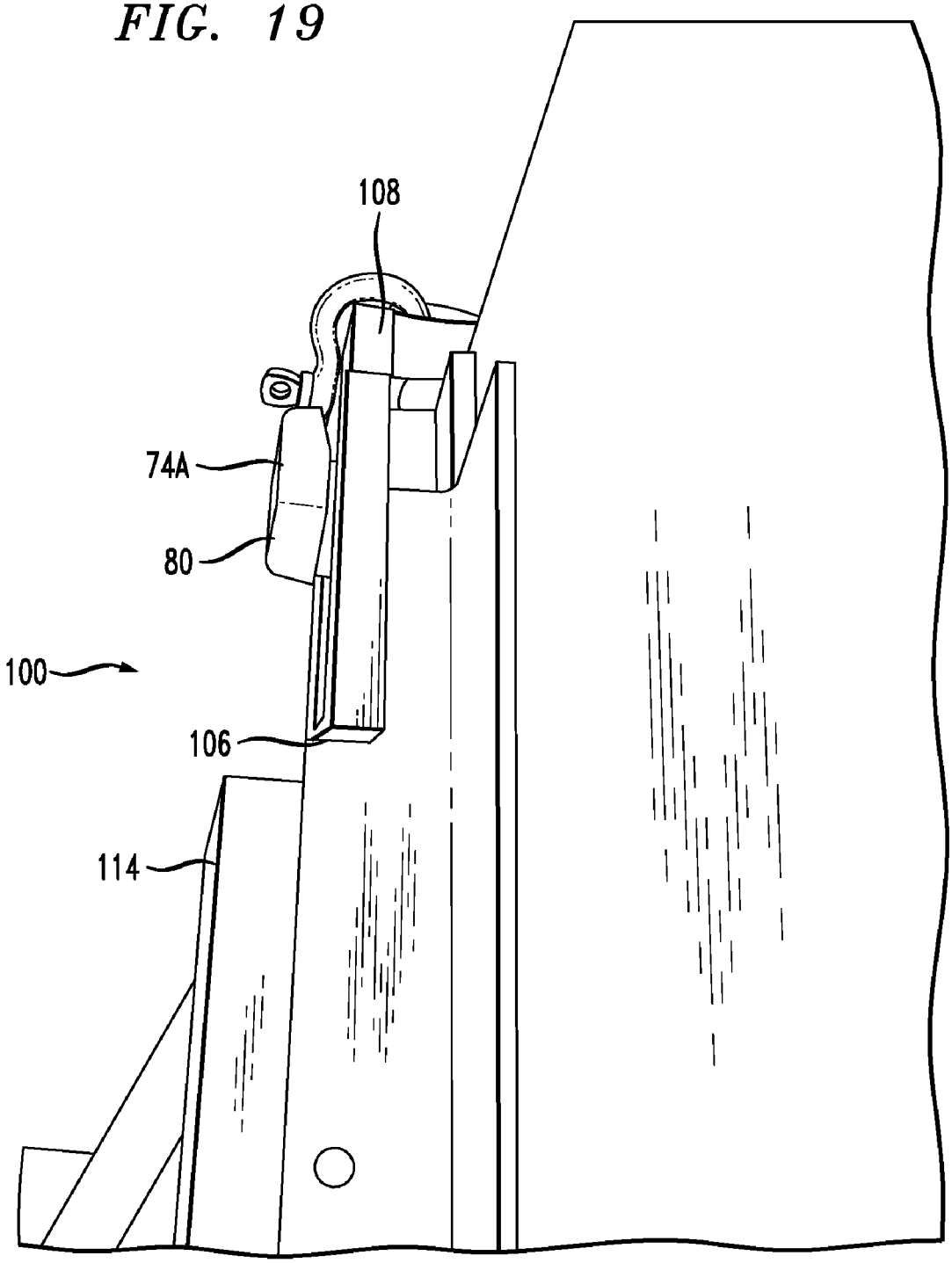
FIG. 19 shows another view of the upper end of the bumper shown in FIG. 18.

A method for securing the above-described bumper 100 to male connectors extending from a modular barge section will now be described in conjunction with what is shown in FIGS. 17-19. FIG. 17 shows a side wall of a modular barge section having a structure similar to the modular barge section 52B shown and described above in FIG. 3. The modular barge section 52B includes an upper male connector 74A adjacent a top surface of the barge section and a lower male connector 74C adjacent a bottom surface of the barge section. The upper and lower male connectors 74A, 74C are in vertical alignment with one another.

A bumper 100, similar to that shown and described above in FIGS. 10-11, is coupled with the upper and lower male connectors 74A, 74C by aligning the C-shaped opening of the lower attachment flange with the reduced diameter neck of the lower male connector 74C, and the large diameter opening of the upper attachment flange with the upper male connector 74A. After the tip of the upper male connector is passed through the large diameter opening of the upper attachment flange, the bumper 100 may be moved in a downward direction toward the bottom surface of the barge section 52B. The bumper 100 is moved toward the bottom surface of the barge section until the closed end of the C-shaped opening of the lower attachment flange engages the reduced diameter neck of the lower male connector 74C, and the reduced diameter section of the upper attachment flange engages the reduced diameter neck of the upper male connector. The locking pin 123 shown in FIG. 11 may be inserted into the locking pin opening 125 to prevent the bumper from moving upwardly and decoupling from the upper and lower male connectors 74A, 74C.

FIG. 18 shows the upper end of the bumper 100 after the bumper has been coupled with the upper male connector 74A of the modular barge section 52B. As shown in FIG. 18, the larger diameter tip of the upper male connector 74A extends through the opening in the upper connector flange 108, with the reduced diameter section of the flange opening being in contact with the reduced diameter neck of the male connector 74A. Although not shown in FIG. 18, the lower flange connector at the lower end of the bumper is coupled with the lower male connector shown in FIG. 17. The locking pin (not shown) passes laterally underneath the upper male connector and through the bumper to prevent the bumper from moving upwardly and becoming decoupled from the upper male connector 74A.

FIG. 19 shows another view of the upper end of the bumper 100 after the bumper has been coupled with the upper male connector 74A. As shown in FIG. 19, the tip 80 of the upper male connector 74A extends through the opening in the upper attachment flange 108, as the reduced diameter section of the flange opening engages the reduced diameter neck of the male connector. The insert 114 and the frame 106 extend in a vertical direction between the upper and lower male connectors. The insert 114 is secured to the frame by fasteners that extend through aligned openings in the insert and the frame. Although not shown in FIGS. 17-19, lateral inserts may be secured to the side walls of the frame, or opposite sides of the frame.

Figure 20A:
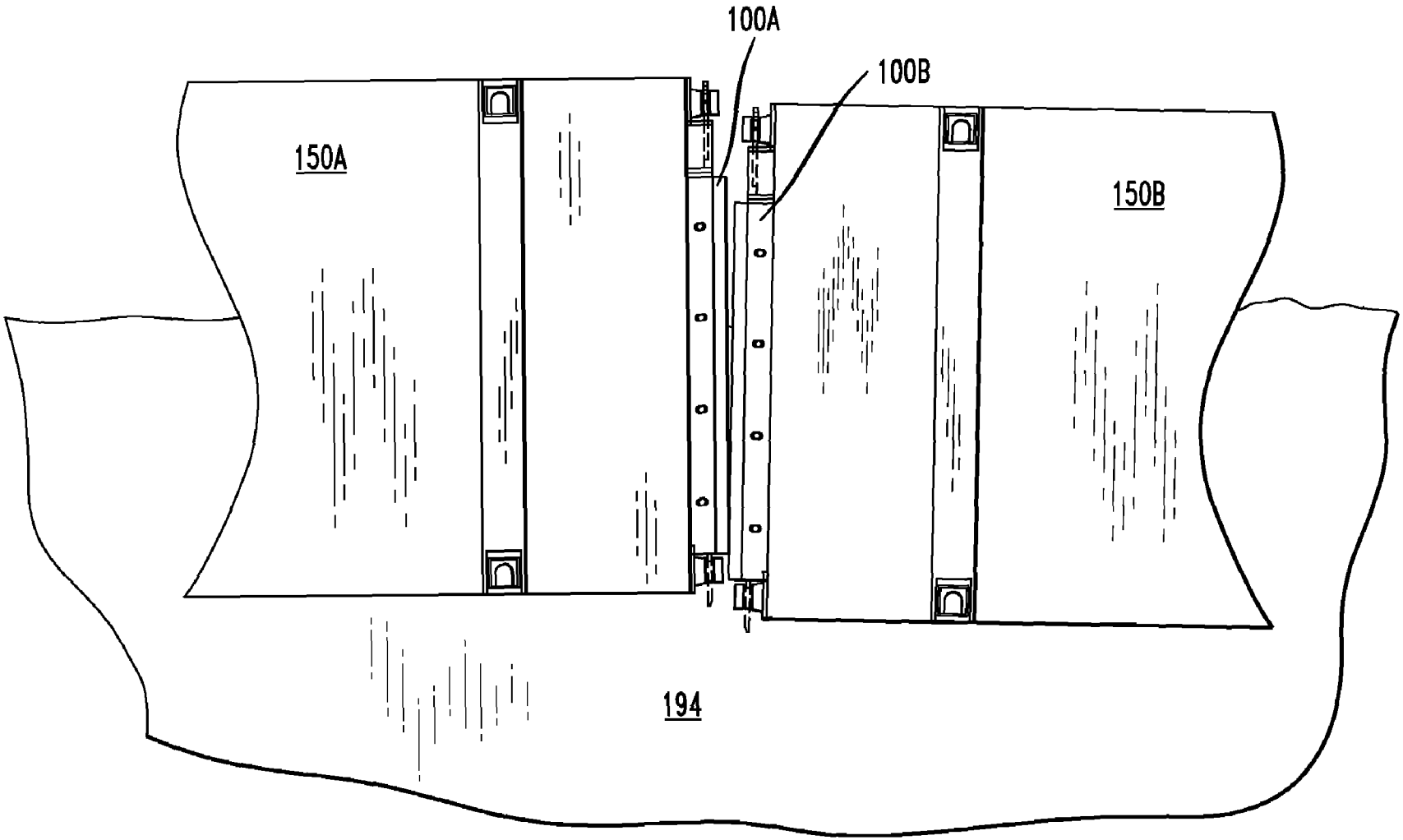
FIG. 20A shows two opposing same size modular barge sections, each having one of the bumpers shown in FIG. 10 coupled therewith.

Referring to FIG. 20A, two barges 150A, 150B float next to one another in the water 194. The two barges have the same size and dimensions. The first barge 150A is carrying a lighter load than the second barge 150B, which causes the second barge 150B to have a greater draft than the first barge 150A. As a result, the two barges are not at the same elevation relative to one another. Each barge 150A, 150B has male connectors extending from side walls thereof, and the bumpers described above in FIGS. 10-11 are coupled with the male connectors. The bumpers 100A, 100B extend between top and bottom surfaces of the barges and extend in generally vertical directions relative to the top and bottom surfaces of the barges.

Figure 20B:
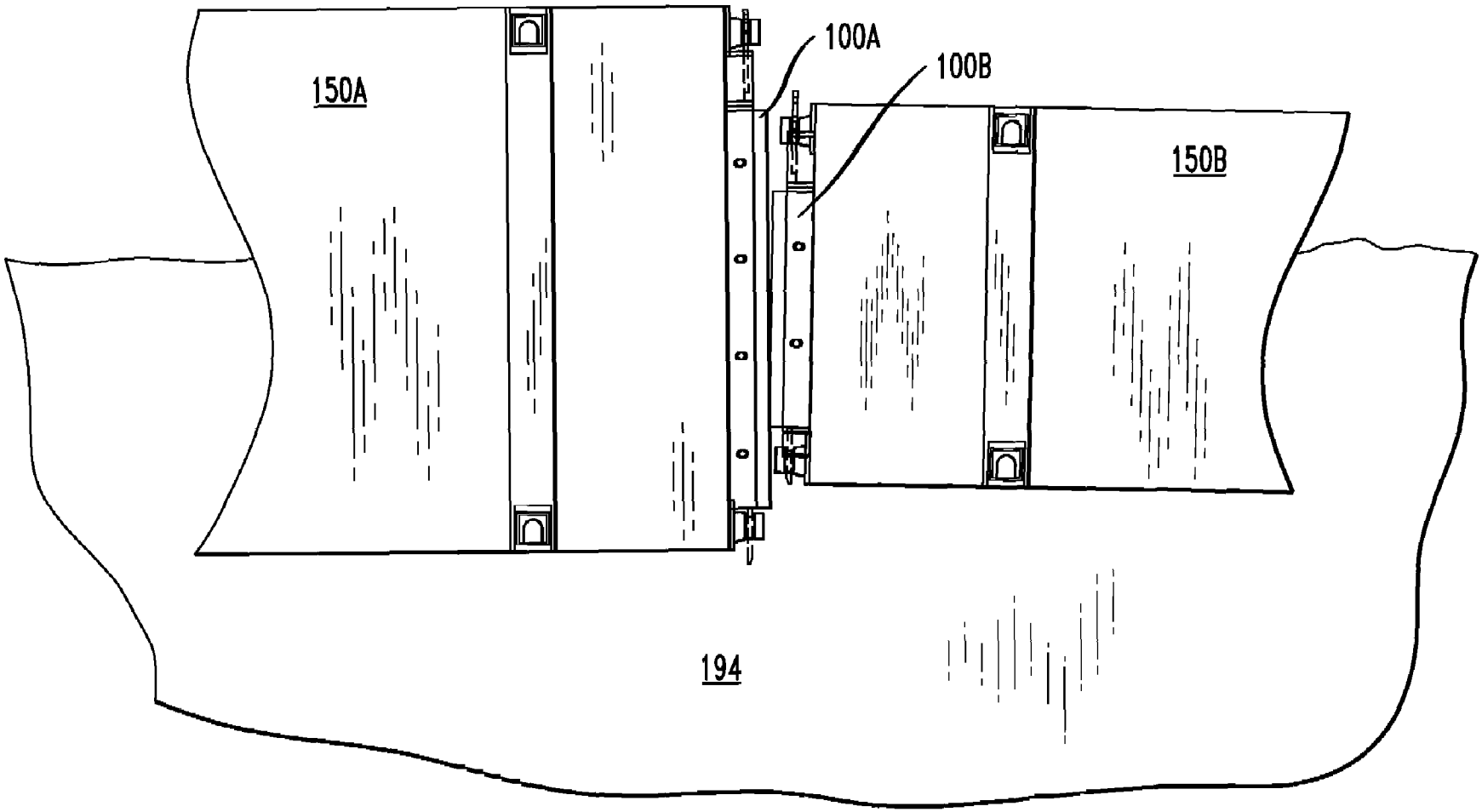
FIG. 20B shows two opposing different size modular barge sections, each having one of the bumpers shown in FIG. 10 coupled therewith.
Figure 20C:
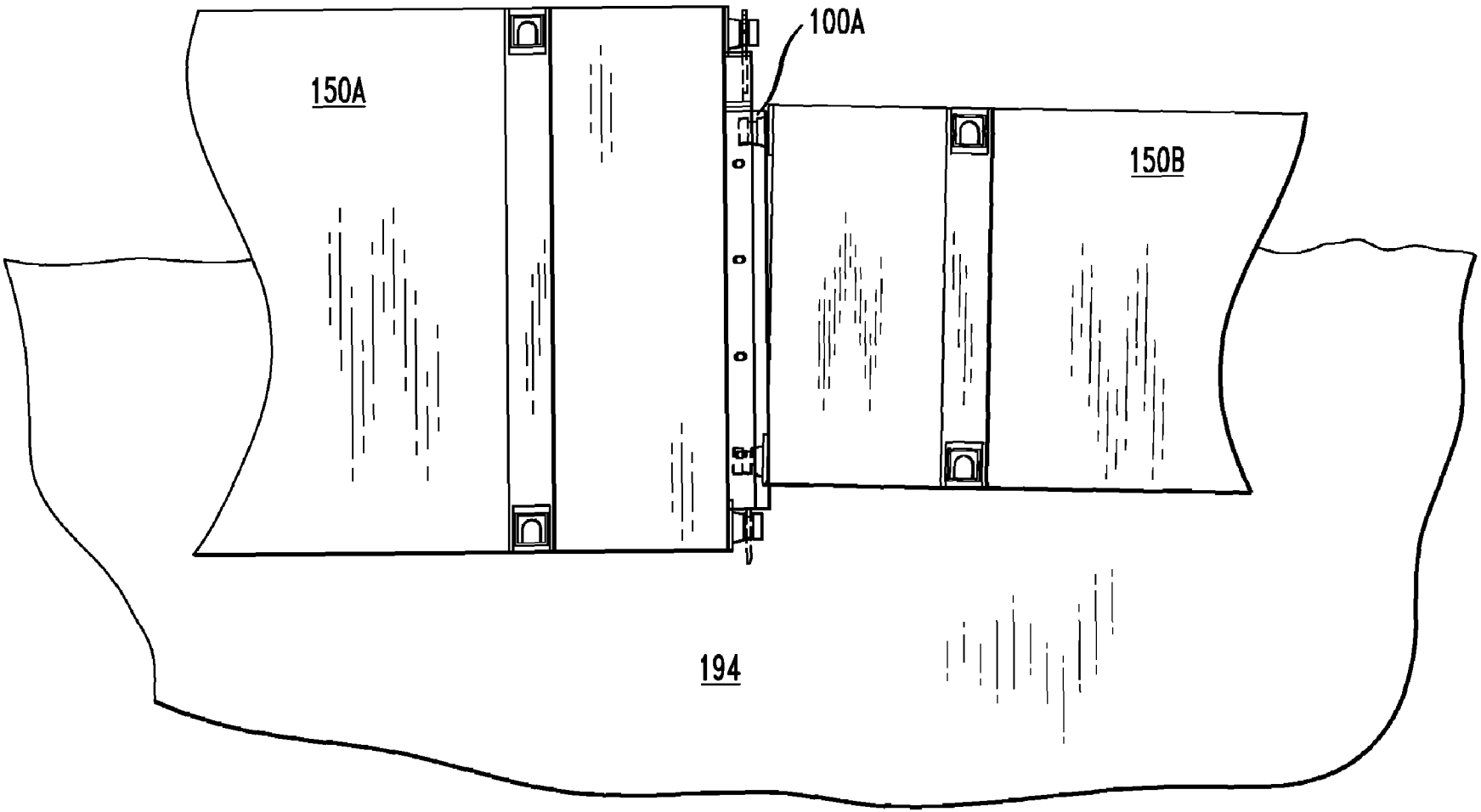
FIG. 20C shows two opposing different size modular barge sections, with one barge having the bumper shown in FIG. 10 coupled therewith.

Referring to FIG. 20B, two barges have different dimensions and as such have different drafts. As a result, the two barges are not at the same elevation relative to one another. Each barge 150A, 150B has male connectors extending from side walls thereof, and the bumpers described above in FIGS. 10-11 are coupled with the male connectors. The bumpers 100A, 100B extend between top and bottom surfaces of the barges and extend in general vertical directions relative to the top and bottom surfaces of the barges. Referring to FIG. 20C, only one barge is carrying the bumper as described above and even the one bumper is operating to substantially minimize or prevent damage to both barges.

Figure 7:
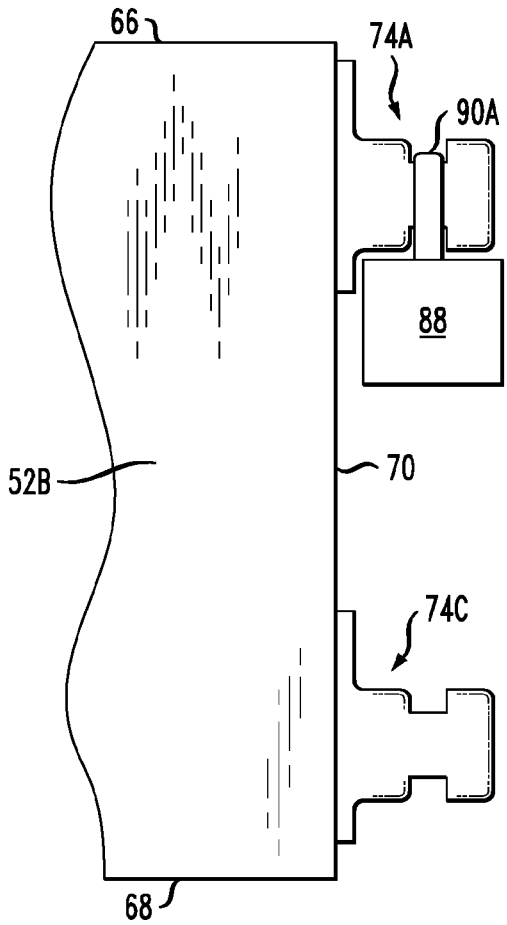
FIG. 7 PRIOR ART
FIG. 7 shows a conventional bumper covering two male connectors of the modular barge section shown in FIG. 6.
Figure 8A:
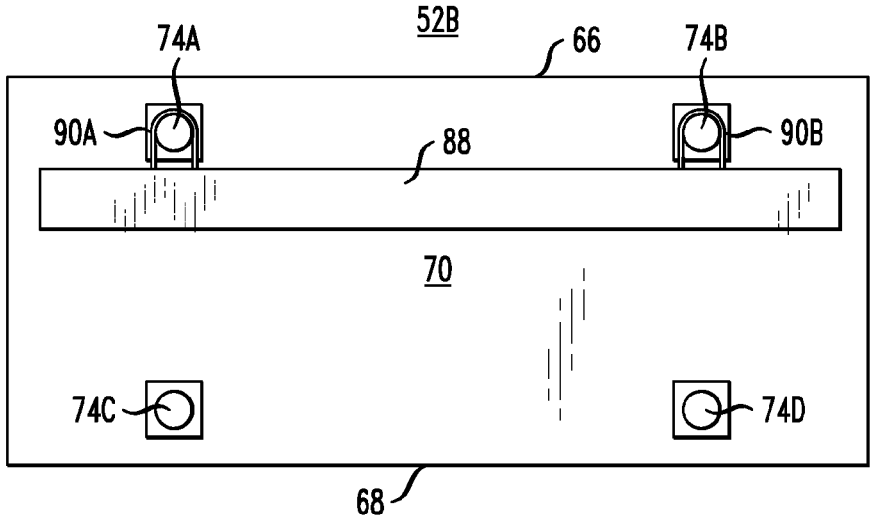
FIG. 8A PRIOR ART
FIG. 8A shows a front elevational view of the bumper and the modular barge section shown in FIG. 7.
Figure 8B:
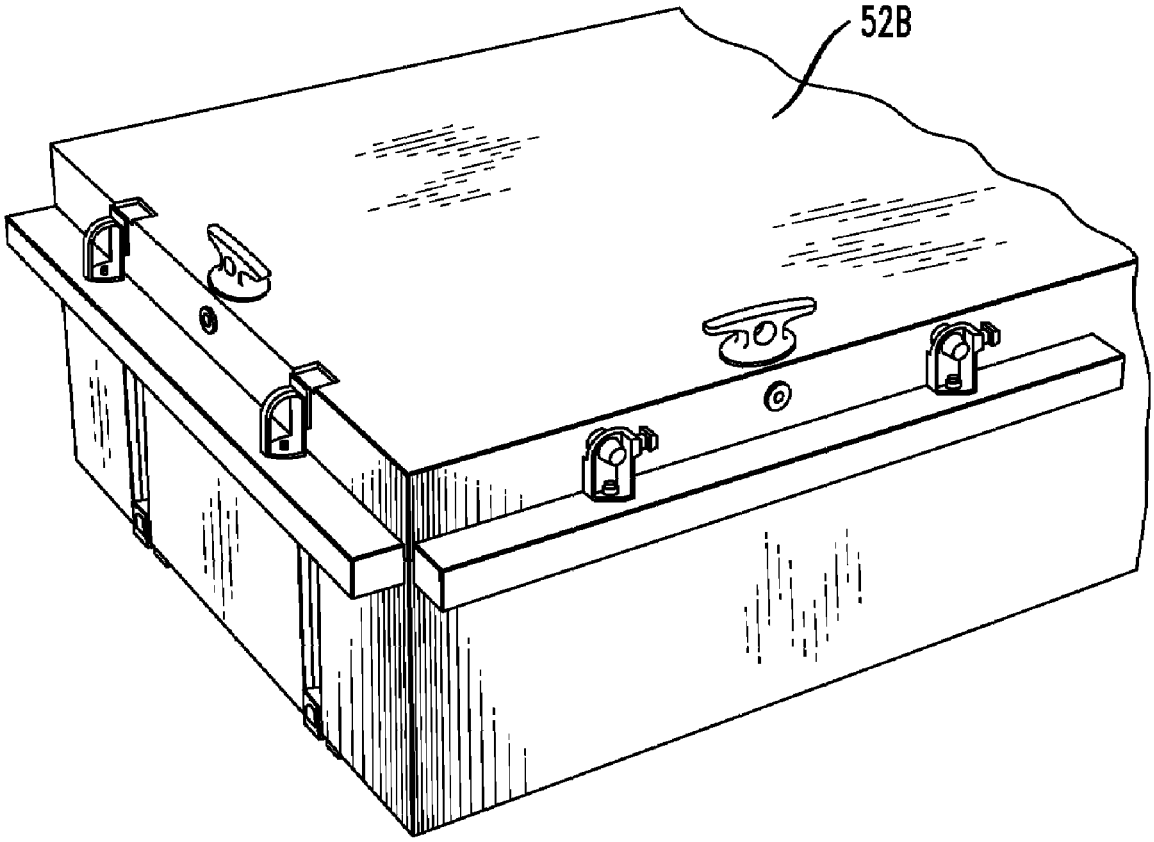
FIG. 8B PRIOR ART
FIG. 8B shows a perspective view of the bumper and the modular barge section shown in FIG. 8A.
Figure 9A:
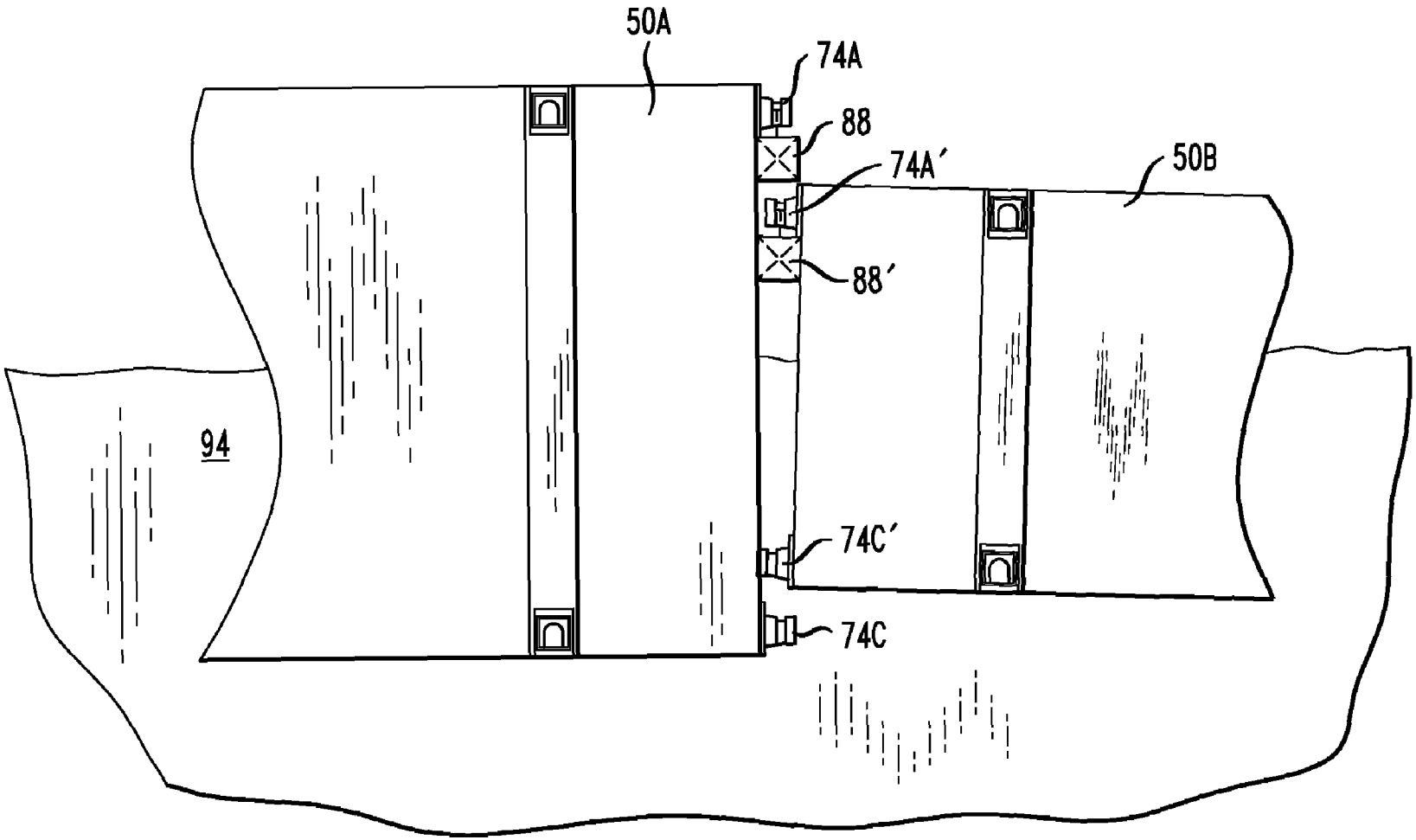
FIG. 9A PRIOR ART
FIGS. 9A and 9B each show two opposing modular barge sections having the conventional bumpers of FIG. 7 coupled therewith.
Figure 9B:
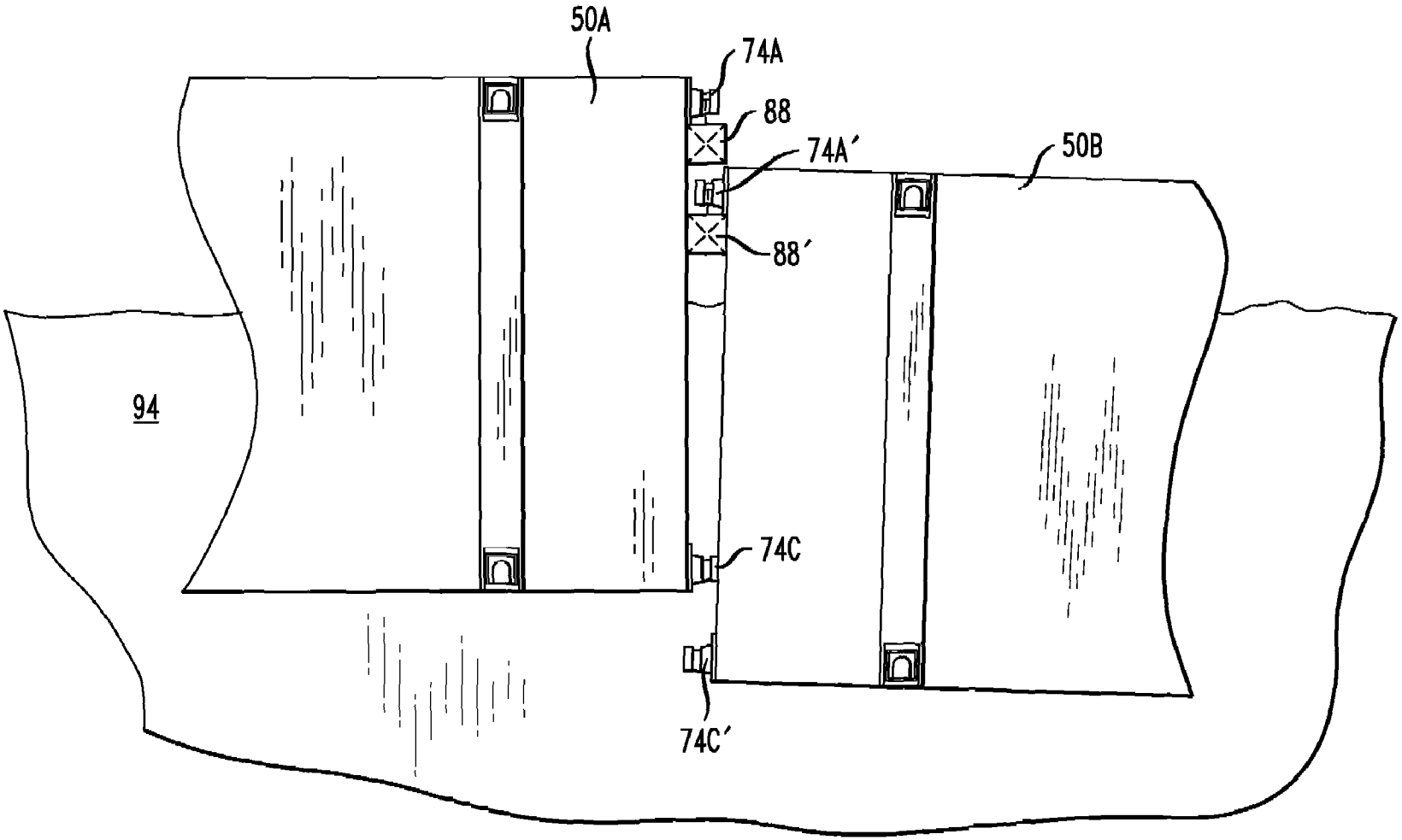
FIG. 9B PRIOR ART

Although the present invention is not limited by any particular theory of operation, it is believed that providing bumpers that extend in generally vertical directions will advantageously protect the side walls of barges when opposing barges are at different drafts relative to one another. Bumpers 100A, 100B are embodiments of the present invention that provide an improvement over prior art bumpers (see FIGS. 7-8B) that extend in horizontal directions.

In addition, the bumpers of embodiments of the present invention may be easily coupled with and removed from the male connectors of modular barge sections. As discussed above, known bumpers are usually attached using tools and permanent fastener. In contrast, the bumpers of embodiments of the present invention may be attached and detached quickly, without requiring special tools or permanent fasteners. In addition, embodiments of the present invention enable barges having a wide range of dimensions and shapes to be assembled, whereby the male connectors exposed on the periphery of the barge may be readily covered by bumpers.

Although the invention herein has been described with reference to particular embodiments, it is to be understood that these embodiments are merely illustrative of the principles and applications of the present invention. For example, the bumpers disclosed in the present invention may be attached to any type of structure, whether stationary or movable, in water or on land. The present invention may also be used to protect any type of vessel, whether the vessel is a sea-going vessel or a land vessel (e.g., an automobile, truck, bus, camper, RV, etc.). It is therefore to be understood that numerous modifications may be made to the illustrative embodiments and other arrangements may be devised without departing from the spirit and scope of the present invention.

What is claimed is:

1. A system for protecting a modular barge comprising:

a modular barge section having a top surface, a bottom surface, a side wall extending between the top and bottom surfaces, and at least one male connector projecting from the side wall juxtapose the top surface, and at least one male connector projecting from the side wall juxtapose the bottom surface; and a bumper having a first end coupled with the at least one male connector juxtapose the top surface, the first end comprising an aperture having a larger width section and a smaller width section, and a second end coupled with the at least one male connector juxtapose the bottom surface, the second end comprising an outwardly-facing U-shaped opening, wherein the bumper extends between the top and bottom surfaces of the modular barge section.

2. The system as claimed in claim 1, wherein the bumper extends in a direction substantially perpendicular to the top and bottom surfaces of the modular barge section.

3. The system as claimed in claim 1, wherein the at least one male connector projecting from the side wall juxtapose the top surface and the at least one male connector projecting from the side wall juxtapose the bottom surface are vertically aligned with one another.

4. The system as claimed in claim 3, further comprising:

a second bumper having a first end coupled with a second male connector juxtapose the bottom surface, the first end of the second bumper comprising an aperture having a larger width section and a smaller width section, and a second end coupled with a second male connector juxtapose the top surface, the second end of the second bumper comprising an outwardly-facing U-shaped opening, wherein the second bumper extends between the top and bottom surfaces of the modular barge section.

5. The system as claimed in claim 4, wherein the bumpers extend in directions substantially parallel to one another.

6. The system as claimed in claim 1, wherein the modular barge section comprises a second side wall having at least one female opening formed therein that is adapted to receive one or more male connectors of a second modular barge section for assembling the first and second modular barge sections together.

7. The system as claimed in claim 1, wherein the bumper comprises a metal frame and at least one insert attached to the metal frame.

8. The system as claimed in claim 7, wherein the insert comprises energy absorbing material.

9. The system as claimed in claim 7, wherein the frame has a locking pin opening and the system further comprises a locking pin insertable into the locking pin opening.

10. A modular barge comprising:

a plurality of modular barge sections, each the modular barge section having a top surface, a bottom surface, a side wall extending between the top and bottom surfaces, at least one male connector projecting from the side wall juxtapose the top surface, at least one male connector projecting from the side wall juxtapose the bottom surface, and female openings, wherein the female openings are adapted to receive the at least one male connector for assembling the modular barge sections together;

a bumper having a first end coupled with the at least one male connector juxtapose the top surface, the first end comprising an aperture having a larger width section and a smaller width section, and a second end coupled with the at least one male connector juxtapose the bottom surface, the second end comprising an outwardly-facing U-shaped opening, the bumper extending between the top surface and the bottom surface of the modular barge.

11. The modular barge as claimed in claim 10, wherein the bumper extends substantially vertically between the top and bottom surfaces of the modular barge.

12. A method of assembling and protecting a modular barge comprising:

providing a plurality of modular barge sections, each the modular barge section having a top surface, a bottom surface, a side wall extending between the top and bottom surfaces, a plurality of male connectors projecting from the side wall juxtapose the top surface, a plurality of male connectors projecting from the side wall juxtapose the bottom surface, and a plurality of female openings, wherein the plurality of female openings are adapted to receive the plurality male connectors for assembling the modular barge sections together;

assembling the modular barge sections together by inserting at least one of the plurality of male connectors into at least one of the plurality of female openings, wherein at least one of the plurality of male connectors are exposed at an outer periphery of the assembled modular barge;

coupling at least one bumper with at least one of the exposed male connectors, wherein the at least one bumper extends between the top and bottom surfaces of the modular barge sections.

13. The method as claimed in claim 12, wherein the at least one bumper extends vertically between the top and bottom surfaces of the modular barge sections.

14. The method as claimed in claim 12, further comprising coupling a bumper with each of the exposed male connectors.

15. The method as claimed in claim 14, wherein the exposed male connectors include sets of two or more male connectors vertically aligned with one another, wherein each of the bumpers is coupled with one of the sets of male connectors.

16. The method as claimed in claim 12, wherein the assembling step comprises coupling a first end of a first bumper with a first male connector juxtapose the top surface of a first modular barge section and coupling a second end of the first bumper with a second male connector juxtapose the bottom surface of the first modular barge section.

* * * * *